United States Patent [19]

Bullen

[11] 4,437,855

[45] Mar. 20, 1984

[54] REDUCTION OF CUTOFF LENGTH FOR FOLDING MECHANISMS

[75] Inventor: Lee Bullen, Dallas, Tex.

[73] Assignee: Publishers Equipment Corporation, Carrollton, Tex.

[21] Appl. No.: 370,159

[22] Filed: Apr. 21, 1982

Related U.S. Application Data

[63] Continuation of Ser. No. 133,342, Mar. 24, 1980, abandoned.

[51] Int. Cl.[3] ..... B65H 45/16

[52] U.S. Cl. ..... 493/424; 493/427; 493/432; 270/50

[58] Field of Search ..... 270/4, 6, 7, 47–50; 493/424–435

[56] References Cited

U.S. PATENT DOCUMENTS

| | | | |
|---|---|---|---|
| 1,269,675 | 6/1918 | Ball | 270/4 X |
| 2,026,443 | 12/1935 | Tomlin | 493/431 X |
| 2,814,484 | 11/1957 | Stobb | 493/370 X |
| 3,038,719 | 6/1962 | Tyma | 493/431 X |
| 3,477,709 | 11/1969 | Neal | 493/424 |
| 3,544,107 | 12/1970 | Blomberg | 493/439 |
| 4,289,493 | 9/1981 | Hedrich | 493/426 |

*Primary Examiner*—A. J. Heinz

*Attorney, Agent, or Firm*—Robert V. Jambor

[57] ABSTRACT

A method and apparatus for reducing the cutoff length of a duel web folding and cutting assembly. The method comprises steps of reducing the support surface under the working parts of the folding cylinder along the length of a roller which contacts the web such that the working parts may be replaced without modification. Further, the cutting rollers reduced in diameter must be moved closer to the folding cylinder. One method of moving the cutting cylinder is by reboreing the mounting hole for one end of the cutting cylinder on the drive side to enable placement of sleeve having eccentric center holes in each side frame to move the cylinder closer. The other method comprises steps of cutting the driven side of the cutting cylinder support shaft off positioning it in an auxiliary side frame mounted inside of the old side frame and driving cutting cylinder with gears positioned inide of the auxiliary side frame.

3 Claims, 8 Drawing Figures

REDUCTION OF CUTOFF LENGTH FOR FOLDING MECHANISMS

This is a continuation of application Ser. No. 133,342, filed Mar. 24, 1980 now abandoned.

DESCRIPTION

TECHNICAL FIELD

This invention relates to reduction of the paper cutoff length and conversion of existing paper folding units and particularly to conversion of a 3/2 folding and cutting unit to reduce the paper cutoff length.

Due to economic conditions, todays cost of operating a printing facility or newspaper continues to increase. One of the principle increases in the cost of production is the cost of paper and ink. Many of the newspapers today use 23 9/16 to 22¾ inches for a cutoff length and wish to convert to between 56 centimeters and 21½ inches. The resulting reduction in cutoff length results in 3 to 9% savings of paper without appreciable reduction in printing space. This would result in a tremedous savings in production cost and energy.

Many of today's newspapers are converting to a European paper length of 56 centimeters from a length of 22.75 inches. Since the folder is generally connected to a web type printing press, it is a complex matter to simply reduce the size and maintain the same surface speed of the paper moving through the folder as well as the strength of the cylinders of the folder. Most folders in the newspaper industry are of a dual type having a first fold unit positioned above, then a cutting mechanism and a second fold unit to make the final crease below. Several webs of paper are usually combined such that an entire paper or section of paper is cut and folded in one operation.

Several million dollars of investment are tied up in machinery geared to fold and cut the longer lengths of paper, such as 22.75 inches. A switch over a shorter length of paper, such as 56 centimeters, requires either a conversion of the existing unit or abandonment of the equipment.

The method described in this application covers many different size reductions, for example, 22¾ inches to 56 centimeters often used in the Imperial 3/2 folder described in U.S. Pat. No. 3,038,719 which description is incorporated herein for all purposes. However, this folder does cut and fold many other sizes.

DISCLOSURE OF INVENTION

This invention is directed to conversion of the unit which allows maximum use of existing portions of the cutting and folding mechanism and retaining their strength. The cutting and folding mechanism briefly comprises an upper folding unit where the web is folded in half and driven toward a tucking roller and a cutting roller secured betwen two sides frames. The tucking roller has a spider mechanism adapted to guide a pair of tucking blades between two second fold rollers. A separate cutting roller has a pair of serrated blades being adapted to cut the web at a specified length. The problem is to reduce the diameter of the tucking roller and cutting roller without disturbing the gearing of the tucking blades which encompasses the most complicated portions of the machine and yet reduced the cutoff length of the paper.

One method briefly comprises positioning a fixture in the side frame after the removal of all the rollers from the device to enlarge the bore of the hole in the side frame supporting one end of the cutter roller adjacent the drive side. A pair of the sleeves having eccentric or off-center holes are then positioned in the enlarged bore and the existing bore in the other side frame to reduce the center distance between the tucking roller and the cutting roller. The cutting roller is reduced in diameter and the depth of pocket for the blades is increased to compensate for the reduction in diameter.

The tucking roller is modified by removing the retaining pin assemblies, of which there are three, and milling the surfaces of the retaining pin assemblies support casting inwardly approximately 11/32 of an inch parallel to longitudinal axis of the retaining pins and the counterbores which they fit into. Further, the counterbores must be deepened and a new bearing location must be formed for the pin shaft which operates the retaining pins. The surfaces on the periphery of the tucking roller about the retaining pin assemblies are thus reduced in diameter approximately 11/16 of an inch without reducing the strength of the tucking roller. The retaining pin assembly is replaced without being modified.

The tucking roller has a series of adjustable bands positioned thereon which must be reduced. An adjusting mechanism retains one end of the bands. The bands are removed at both ends such that the surface area supporting the adjusting mechanism and the fixed end can be reduced such that the bands may be repositioned. A portion of the adjusting mechanism is modified to permit use of the adjusting mechanism. These bands adjust for different thicknesses of papers from a single web to a 160 page newspaper.

Thus, the tucking blade still centers between the two second fold rollers just below the tucking roller. This is mandatory since there is only a small fraction of an inch clearance as the tucking blade swings around and tucks the web between the two rollers. The second fold rollers are reduced in diameter and remounted in the same adjustable levers.

The web is moving through the press at a surface speed equivalent to the surface speed of the smaller diameter printing cylinders. Some of the gears driving rollers in the upper folder and lower folder are changed to match their surface speeds with the surface speed of the printing cylinders in the press.

A second method of reducing the center distance between the tucking and cutting rollers includes inserting an auxiliary side frame adjacent the interior of the side frame on the drive side of the folder. A power-take-off shaft is positioned through the auxiliary and old side frame. The end of the cutting cylinder is cutoff and positioned in a new bearing in the auxiliary side frame. A gear is positioned on the shortened end of the cutting cylinder and driven by the power-take-off shaft to drive the cutting cylinder. A stub shaft is mounted in the old cutting cylinder support hole to support the old driven gear to drive the folding cylinder. This method reduces the need for on-site milling and boring modifications which are more difficult to control the accuracy of.

A primary object of the invention is to convert existing cutting and folding mechanisms such that they will be able to cut at the shorter length of paper by utilizing existing parts and assemblies.

A further object of the invention is to minimize conversion cost, thus maximizing the use of existing folding unit and equipment thus minimizing waste and energy loss of this equipment.

A still further object of the invention is to reduce the cutoff length of the paper thus reducing the production cost in printing facilities by converting existing equipment.

A still further object of the invention is to reduce the diameter of the tucking roller without reducing the strength of the cylinder and enable existing moving parts to be replaced.

Other and further objects of the invention will become more apparent upon studying the detailed description hereinafter following and the drawings annexed hereto.

DESCRIPTION OF THE DRAWINGS

Drawings of two embodiments of the invention are annexed hereto so that the invention may be better and more fully understood, in which.

Numeral references are used to designate like parts throughout the various figures of the drawings.

DESCRIPTION OF PREFERRED EMBODIMENT

Figure 6:
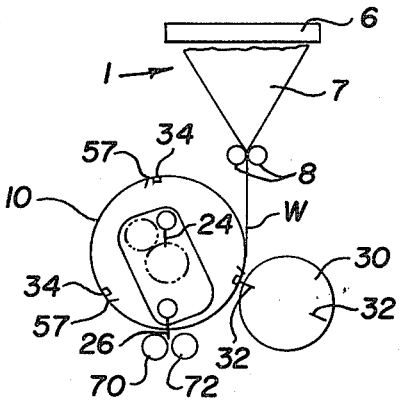
FIG. 6 is a diagramatic view showing the cylinders.
Figure 7:
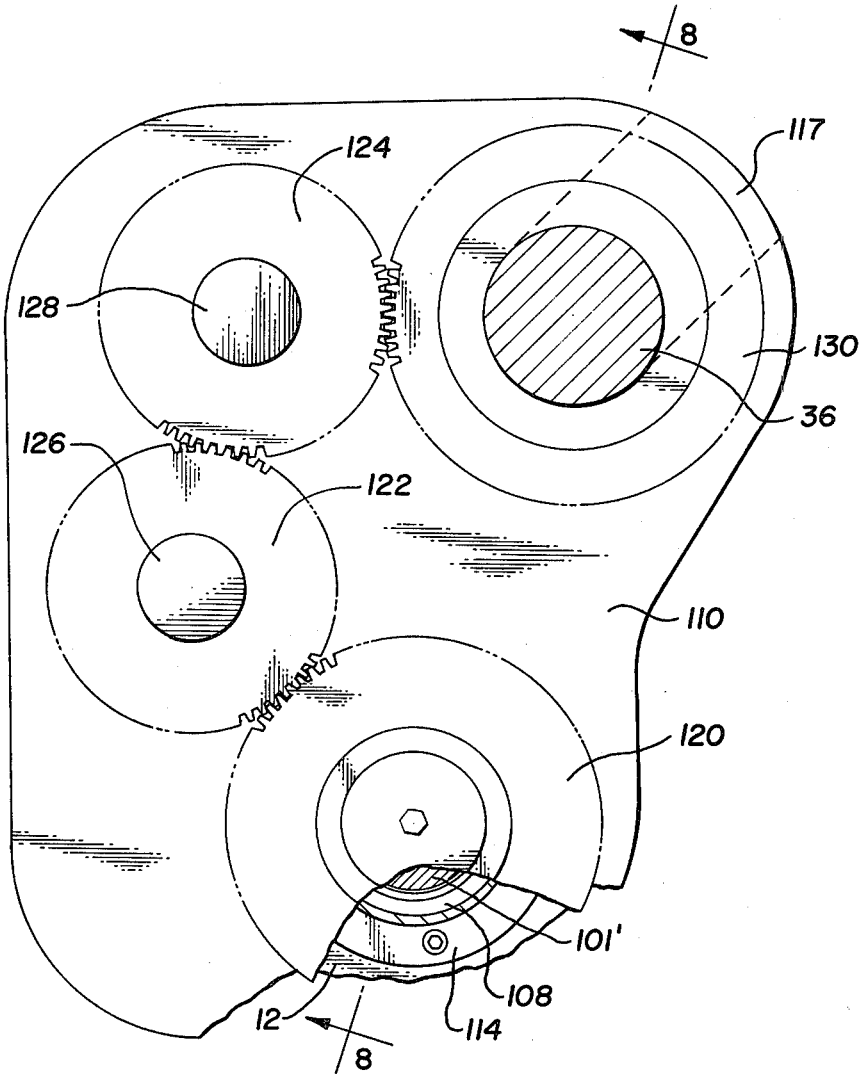
FIG. 7 is an elevational view showing a relative location of the auxiliary side frame and drive assemblies.
Figure 8:
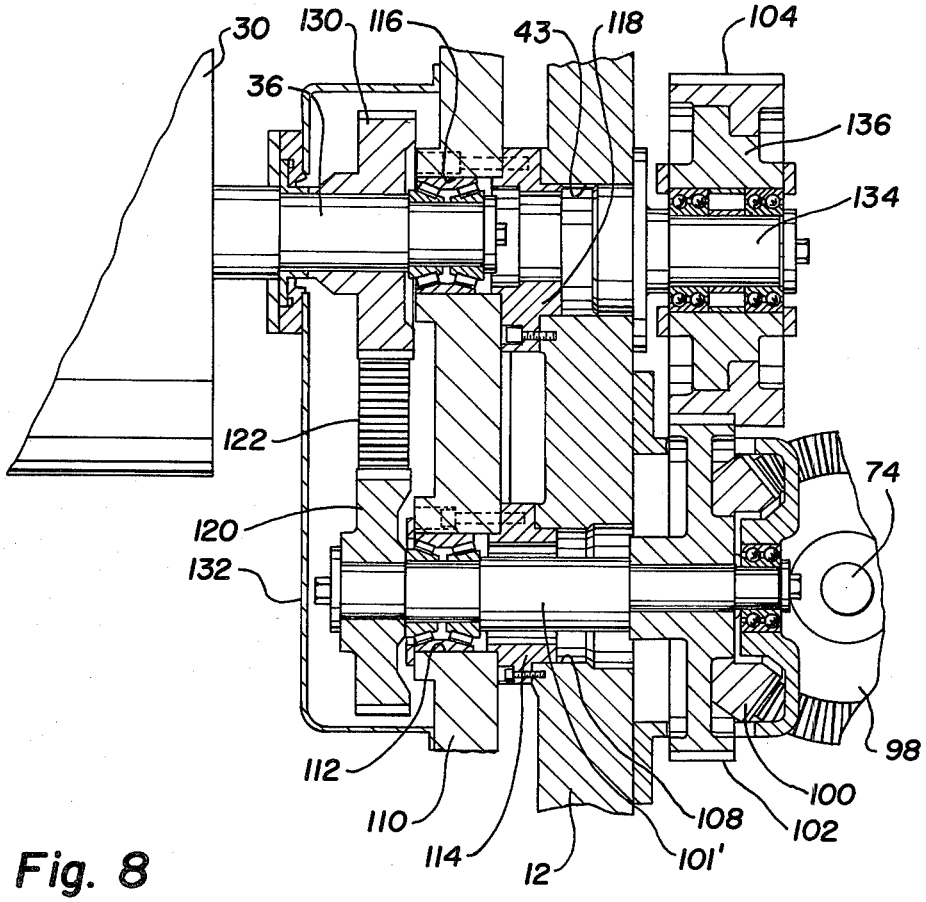
FIG. 8 is a cross-sectional view taken along line 8—8 of FIG. 7.

The folder-cutting assembly has an upper assembly 1 (FIGS. 4 and 6) which folds the paper once. A web W or plurality of webs coming off the press (not shown) move over a first drive roller 6 to a triangular shaped guide 7 which guides the web W into the first fold rollers 8. As the web W moves between two first fold rollers 8, the paper is folding once. The web W is routed onto a tucking roller 10.

Figure 1:
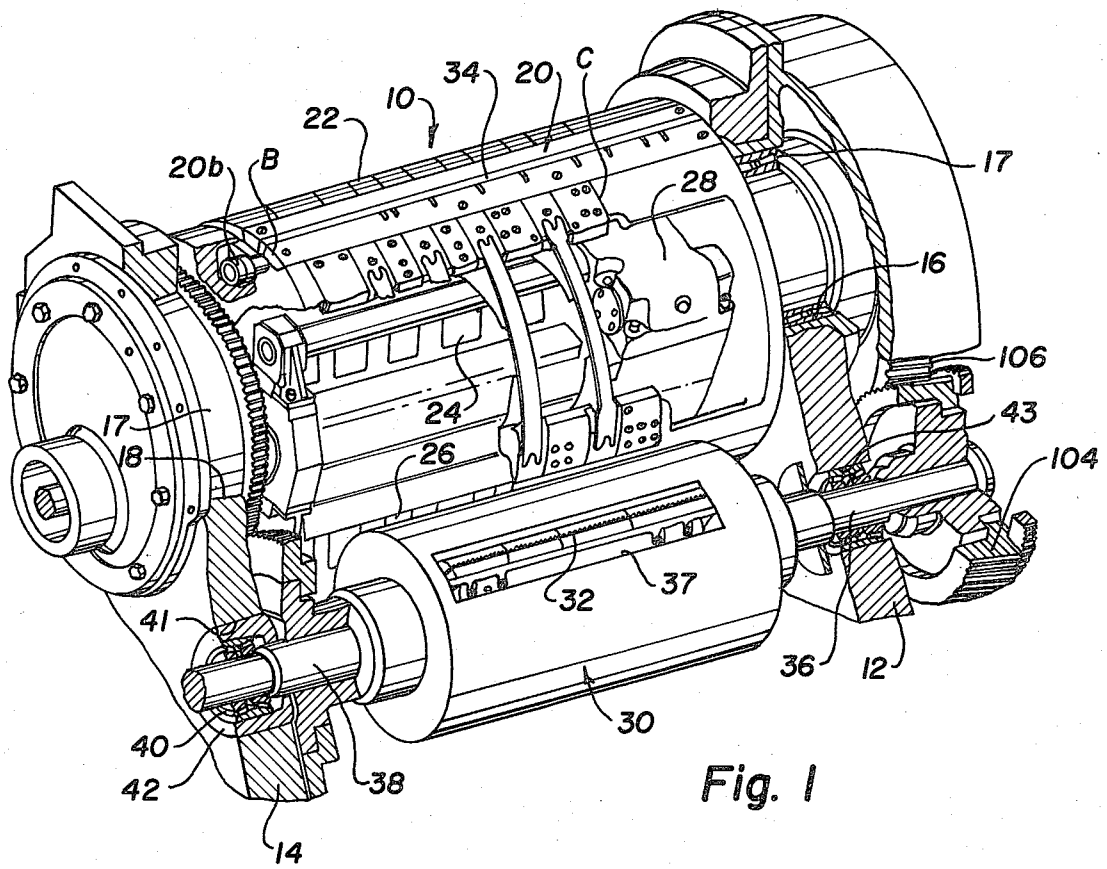
FIG. 1 is a perspective view showing the relation of the tucking and cutting rollers of the folder assembly.

The tucking roller 10 (FIG. 1) is rotatably supported between side frame 12 on the drive side of the assembly and side frame 14. A pair of bearing openings 16 and 18 are formed in side frames 12 and 14 to support bearings 17 and the ends of tucking roller 10. The tucking roller 10 comprises several elements, one of which being the retaining pin assembly 20 which will be more fully explained hereinafter, the adjustable band assembly 22 and a pair of tucking blades 24 and 26. The tucking blades 24 and 26 are driven by a spider type planetary gear assembly 28 within the central portion of the tucking roller 10.

Synchronously driven with the tucking roller 10 is a cutting roller 30 having a pair of cutters 32. Cutters 32 may comprise serrated blades which engage the paper and a rubber cutting bar 34 adjacent to the pin assemblies 20. There are three pin assemblies 20 in the tucking roller 10 and two knife assemblies 32 in the cutting roller 30, thus a 3-2 relationship.

The cutter roller 30 is positioned on a pair of shafts 36 and 38 which are supported by bearings 40 and a single bearing sleeve 42 in opening 41 in side frame 14 and the opening 43 in side frame 12. Located below the lower most position of tucking blades 24 and 26 are a pair of second fold rollers 70 and 72 such that the tucking blade 24 or 26 extends just between the nip or adjacent the nip between the two second fold rollers 70 and 72 such that the web W is cut and simultaneously forced between the second fold rollers 70 and 72. The finished product is driven from between the second fold rollers 70 and 72 and guided onto a conveyor belt (not shown).

A first method of shortening the cutoff length begins by first removing the tucking roller 10 and cutting roller 30 from the side frames 12 and 14. The cutting cylinder 30 must be reduced in diameter approximately ½ inch and must be moved approximately ⅝ of an inch inwardly toward the tucking cylinder 10 to reduce the distance by approximately ⅝ of an inch between the axes of rotation of the respective cylinders 10 and 30. The pockets 37 holding the cutters 32 must be cut deeper to compensate the reduced diameter of roller 30.

Figure 5:
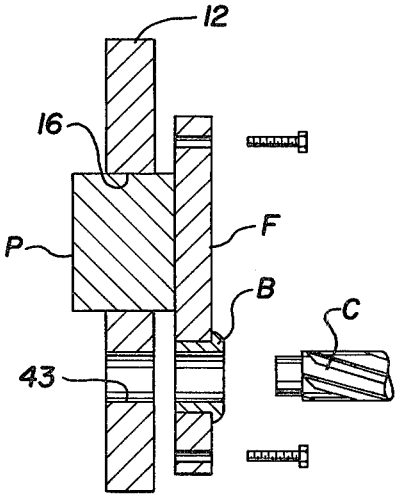
FIG. 5 is a diagramatic view showing pilot assembly and drilling fixture being attached to the side frame for drilling purposes.

One method of reducing the center distance between the two cylinders 10 and 30 is to enlarge the sleeve bearing hole 43 in side frame 12. This is preferably done by taking a fixture F having a pilot P as illustrated in FIG. 5. The fixture F would have a pilot P which may be inserted in opening in side frame 12. A bushing B acts to help guide a cutter C to enlarge opening 43. Fixture F may be bolted to existing bolt hole in side frame 12. Therefore, the tucking cylinder opening 16 forms a location point to aid in enlarging and moving hole 43. In addition, eccentric sleeves having an off-centered center hole is placed in the bored out opening 43 and sleeve 42 in opening 41 is replaced by a sleeve having an off-centered hole to move the cutting cylinder 30 closer to the tucking cylinder 10. A smaller bearing 40 is used in sleeve 42 in frame 14 to allow for the off-centered hole. In addition, drive gears driving both the folding cylinder 10 and the cutting cylinder would have to be replaced by smaller diameter gears to maintain correct surface speed ratios of the web W.

Figure 2:
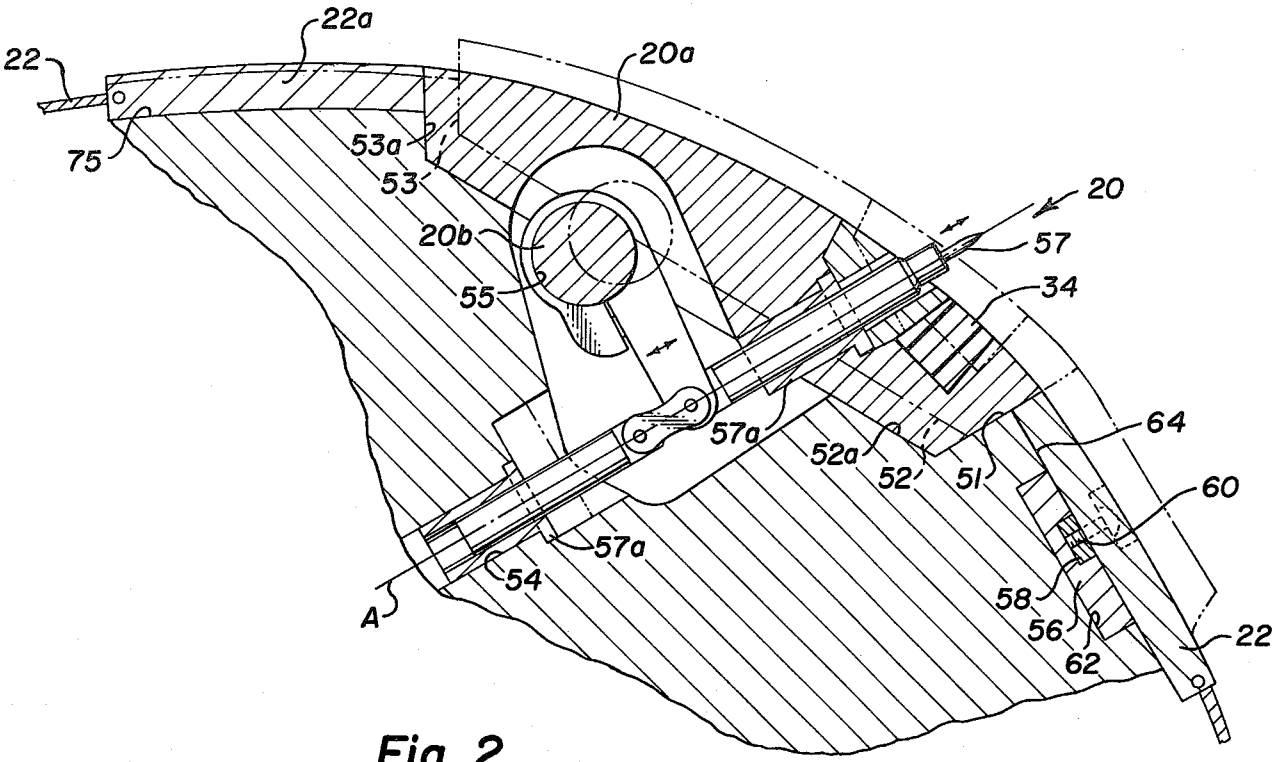
FIG. 2 is a diagramatic view showing portions reduced on the tucking roller in area of the retaining pin assembly and band assembly.

The tucking cylinder 10 must be reduced in diameter approximately 11/16 of an inch in the area contacting the web W to reduce the circumference. By reduction of certain areas, the inner workings of the tucking cylinder 10 such as the tucking blades spider drive assembly 28, the operating mechanism for the retaining pin assembly 20 and the operating mechanism for the adjustable band assembly 22 will remain useable without altering their structure thus weakening them. Referring to FIG. 2, a partial section of roller 10 is illustrated from side elevations showing the retaining pin assembly 20 having a cap **20*a* which is removed along with pin shaft 20*b***.

Suitable linkage is provided between pin shaft **20*b* and pins 57 to move pins 57 out through the paper web W to retain same on the circumferential surface of cylinder 10. The inner walls 51, 52 and 53 of the main casting of cylinder 10 must be milled inwardly parallel to wall 51 and centerline A of the pins 57 and retaining pin counterbores 54 along the length of roller 10 between points B and C. Thus, new surfaces 52*a* and 53*a* are formed to receive cap 20*a* without altering same. The lower bearing support 55 for shaft 20*b* is formed by reboreing. This would permit use of the original pin shaft 20*b* and pin assemblies 20. The counterbores 54 must be deepened in order to receive the lowered pins 57 and sleeve bushings 57*a*. The pin shaft drive assembly (not shown) must be modified only to the extent of changing the size of the drive gear on the pin cam which operates the shaft 20***b* thus saving the all of the pin retaining assembly 20.

Figure 3:
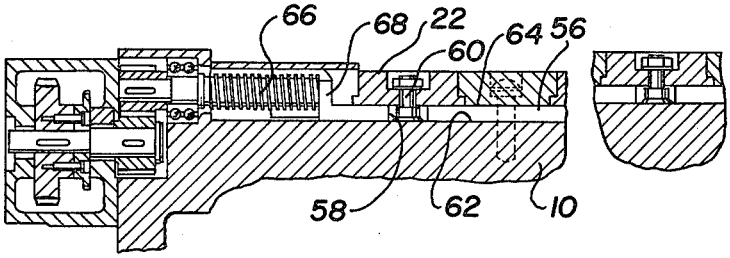
FIG. 3 is a cross-sectional view showing the reduced areas under the band adjusting assembly.

The adjustable bands 22 are spaced apart at periodic intervals such that the tucking blade 24 or 26 actually moves between the spaces in the band 22 to tuck the paper inwardly toward the second fold rollers 70 and 72. The bands 22 are adjustable so as to compensate for different thicknesses and numbers of webs. This is accomplished by a slide bar 56 which has angular formed elongated slots 58 to guide pins 60 circumferentially to cause the bands 22 to buckle upwardly to increase the diameter or downwardly to decrease the diameter. In order to maintain this assembly and its operating mechanism, surfaces 62 and 64 must be milled down approximately 5/16 of an inch. A lug 68 must be formed on the end of slide bar 56 such that it will engage the original adjusting screw 66 of the adjusting band control assembly. In FIG. 3, the old height of the support surfaces is shown on the right as viewed. Surface 75, FIG. 2, supports the fixed end 22*a* and is likewise reduced.

The second fold rollers 70 and 72 are reduced in diameter approximately ⅛ of an inch and the center distance between the fold rollers 70 and 72 be reduced by moving them inwardly. Thus, the tucking assemblies are retained undisturbed saving the heart of the folding unit.

The outside diameter of the tucking roller 10 is thus reduced by reducing the support surface under the working parts without disturbing the working parts or reducing the strength of the parts.

Figure 4:
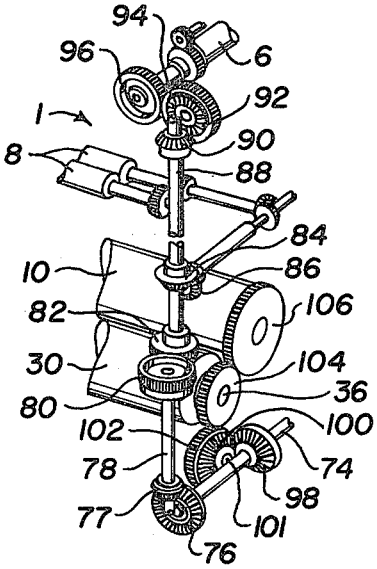
FIG. 4 is a diagramatic view of the gear train.

As illustrated in FIG. 4, the drive train generally consist of a power drive shaft 74 connected to the press. The upper folding unit is driven by a pair of bevel gears 76 and 77 through a shaft 78 to two gears 80 and 82. Gears 80 and 82 must be changed to a different ratio to maintain a surface speed of the paper web W moving through the upper folding unit. Further, bevel gears 84 and 86 must be changed to maintain the surface speed of first fold rollers 8 which are connected by suitable means. Shaft 88 connects the bevel gears 90 and 92 to gears 94 and 96 which must be changed to maintain a surface speed of roller 6 over which the web W moves.

The lower folding unit is driven by bevel gears 98 and 100. Bevel gear 100 is secured to a gear 102 on shaft 101 which drives gear 106 on folding roller 10.

A modified form of reducing the center distance between the axes of rotation of folding cylinder 10 and cutting cylinder 30 begins by moving the cylinders from the side frames 12 and 14.

Bevel gear 100 rotates on shaft 101 which is supported in an opening 108 existing in side frame 12. Shaft 101 is replaced and extends through the opening 108. An auxiliary side frame 110 having a lower opening 112 is mounted on a mounting sleeve 114 which is secured over opening 108 and side frame 12. An upper opening 116 is formed in a location to support shaft 36 of cutter roller 30. Shaft 36 is shortened and mounted in a suitable bearing for rotational movement. A mounting cap 117 allows mounting of shaft 36 in opening 116. An eccentric sleeve is placed in bearing opening 41 in side frame 14 and a smaller bearing 42 is used to move the other end of roller 30 closer as required. A mounting sleeve 118 is secured over cutting roller bearing opening 43 and supports the upper end of auxiliary side frame 110.

New shaft 101' has a drive gear 120 secured thereto which drives intermediate gears 122 and 124 mounted on stub shafts 126 and 128, respectively. A driven gear 130 is mounted on the end of shaft 36 on cutting roller 30 for rotating shaft 30.

An oil cover 132 may be secured over auxiliary side frame 110 with seals to prevent oil leakage into the press area.

A stub shaft 134 is mounted in opening 43 to support a new hub 136 to support gear 104 to drive the folding drive gear 106.

Therefore, the auxiliary side frame 110 permits movement of cutting roller 30 without the necessity of boring the side frame 12 or changing the gear train driving roller 10.

From the foregoing, it should be readily apparent that this method and apparatus permits use of the existing equipment with minimum expense in converting same.

From the foregoing, it should also be readily apparent that other embodiments of the invention may be devised without departing from the basic concept hereof.

I claim:

1. A method of reducing the cutoff length of an existing paper cutting and folding unit operable only at a single cutoff length, said folder having a main frame, a folding cylinder rotatably supported thereon, a cutting cylinder rotatably supported thereon at a fixed non-changeable distance from said folding cylinder, said folding cylinder including a body portion supporting a synchronously timed tucking blade internally thereof, operable pin assemblies mounted adjacent the outer periphery of said body portion, and adjustable bands mounted to define at least a portion of the outer circumferential surface of said folding cylinder, said cutting cylinder including a body portion supporting cutting assemblies in pockets formed adjacent the outer periphery thereof, the steps comprising, removing said pin assemblies and adjustable bands from said body of said folding cylinder, and removing said cutting assemblies from said pockets formed in said body of said cutting cylinder, reducing the diameter of said body of said folding cylinder by permanently removing material therefrom, increasing the size of said pockets formed in said cutting cylinder by permanently removing material from the body thereof, reinstalling said pin assemblies and adjustable bands upon the body of said folding cylinder, reinstalling the cutting assemblies in said pockets in said body of said cylinder, and resupporting said cutting and folding cylinders within said main frame with at least one of said cylinders repositioned with respect to the other upon said main frame at a different, non-changeable distance from the other thereof shorter than their original distance from one another.

2. The method of claim 1 including the further steps of supporting a stationary auxiliary frame upon said main frame, and rotatably supporting only one end of said cutting cylinder upon said auxiliary frame.

3. The method of claim 2 including the further steps of providing a driving input shaft and rotatably supporting the same upon said main frame and auxiliary frame, providing a gear train operatively interconnecting said driving input shaft and said cutting cylinder, and providing a separate gear train operatively connecting said driving input shaft and said folding cylinder.

* * * * *